United States Patent [19]

VanHoutte et al.

[11] Patent Number: 4,745,829

[45] Date of Patent: May 24, 1988

[54] CAN OPENER FOR USE WITH FULCRUM-TYPE OPENER TABS

[76] Inventors: Arthur C. VanHoutte, 24743 Murray Dr.; Earl L. Caber, 24744 Murray Dr., both of Mt. Clemens, Mich. 48045

[21] Appl. No.: 440,925

[22] Filed: Nov. 12, 1982

Related U.S. Application Data

[63] Continuation of Ser. No. 155,204, Jun. 2, 1980, Pat. No. 4,373,246.

[51] Int. Cl.[4] ..... B67B 7/40

[52] U.S. Cl. ..... 81/3.55

[58] Field of Search ..... 81/3.46 R, 3.46 A, 3.34, 81/3 R, 438; 72/458, 459; 29/267, 270, 426.4; 254/28

[56] References Cited

U.S. PATENT DOCUMENTS

| | | | |
|---|---|---|---|
| 1,616,653 | 2/1927 | Frasier et al. | 72/458 |
| 1,725,726 | 8/1929 | Ament | 215/303 |
| 1,949,763 | 3/1934 | Schenk | 81/438 |
| 2,579,930 | 12/1951 | King | 145/61 R |
| 2,609,715 | 9/1952 | Eades | 81/3 R |
| 3,724,297 | 4/1973 | Bucko | 81/3.46 A |
| 4,034,595 | 7/1977 | Smith | 29/267 |
| 4,120,216 | 10/1978 | Goldberg | 81/3.46 A |
| 4,253,352 | 3/1981 | O'Neal | 81/3.46 R |
| 4,304,019 | 12/1981 | Sava | 254/131 |

*Primary Examiner*—Roscoe V. Parker

*Attorney, Agent, or Firm*—Remy J. VanOphem

[57] ABSTRACT

An opener for beverage cans which employ fulcrum-type tab openers is described. Fulcrum-type openers effect the rupture opening of a drinking aperture within a can body through displacement of a key which remains affixed to the can. The key is subsequently rotated back to its original position while the contents of the can are consumed. The opener includes an elongated handle and a tab embracing element which abuts the upper and lower surfaces of the key simultaneously allowing the user to gain a mechanical advantage both in opening the aperture and returning the key to its original position. The opener can be integrally configured from a piece of tubing which has been crimped or flattened at one end or, alternatively, from an elongated piece of metal band. Additionally, advertising indicia can be included on the handle as well as attachment means to permit securing the opener to a single can or multiple container pack as a promotional item.

9 Claims, 2 Drawing Sheets

CAN OPENER FOR USE WITH FULCRUM-TYPE OPENER TABS

This is a continuation of application Ser. No. 155,204, filed June 2, 1980, and now U.S. Pat. No. 4,373,246.

FIELD OF THE INVENTION

The present invention relates generally to openers for pop-top cans and particularly to openers for beverage cans with fulcrum-type tab openers which provide the user with a mechanical advantage in the opening process.

BACKGROUND OF THE INVENTION

Pop-top opener tabs have been employed for many years in application with canned beverages such as beer and soft drinks. The popularity of convenience foods has caused the application of such tabs to be expanded to many other forms of food stuffs in which opening of a can or container is effected by grasping a portion of the tab and pulling, twisting, turning or otherwise displacing the tab with respect to the can, to create an access opening therein by rupturing a weakened or scored portion of the can through physical force.

Two types of pop-top opener tabs have gained general acceptance, particularly in the canned beverage industry. The first is the ring-type opener tab which is the most widely used and the second is the fulcrum-type opener tab which has more recently gained popularity particularly in states which have enacted mandatory beverage container deposit and return laws.

The ring-type opener tab includes a closure member which initially is integrally formed with the top of the associated can and is distinguished from the remainder thereof by a circumferential score line or perforations. An annular metal ring is riveted or otherwise affixed to the closure member and provides leverage during the opening process. An individual opening a can equipped with a ring-type opener tab grabs the ring and rotates it upwardly, away from the top of the can about the rivet, thereby tearing the top along the score line until the closure member is totally severed from the remainder of the can top.

Such ring-type opener tabs have a number of shortcomings and pose problems for certain individual consumers. First, the ring is often located within a recess in the can top and is difficult to grasp with fingers alone. This is a particular problem with infirm or physically disabled individuals. Additionally, individuals with short stubby fingers, long fingernails or no fingernails have difficulty in grasping the ring of typical ring-type tab openers. Furthermore, such openers can pose certain hazards and can be wasteful, in that the tabs are completely severed from the can and are often thrown away in the form of litter rather than returned for recycling. Because canned beverages are often consumed on the beach or other recreational areas where people walk in their bare feet, sharp tabs can easily be stepped upon with predictable results. Additionally, many beverage consumers form a habit of depositing the tab within the beverage can while consuming same thereby exposing themselves to a hazard of inadvertently swallowing the tab in the process of drinking the can's contents.

Fulcrum-type opener tabs also include a closure member which is integrally formed with the top of the can associated therewith and is distinguished from the remainder of the top by scored or perforated lines. A significant difference between fulcrum-type opener tabs and ring-type opener tabs is that, in the former, the score line does not totally encircle the closure member and a key portion, which corresponds with the ring, is riveted to the top adjacently outside of the closure member and has a bearing surface overlaying a portion thereof. The fulcrum-type opener tab is operated by grasping the key portion with the fingers and rotating it upwardly about the rivet. The bearing surface of the key portion pushes downwardly against a portion of the closure member near the scored line to begin to rupture the closure member from the can top. As the key portion is rotated upwardly, the rupturing process follows the circumferential edge of the closure member, substantially severing it from the rest of the can with the exception of the unscored hinge. By virtue of the abutting surface overlaying the closure member, the closure member is rotated downwardly out of the way when the key portion is oriented substantially normal to the can top. The key portion is then rotated back to its stowed or initial position. The obvious advantage of the fulcrum-type opener tab over the ring-type is that the closure member as well as the key portion remains attached to the can during and after consumption of the beverage therein.

Numerous implements have been suggested in the prior art to aid individuals in operating ring-type opener tabs. These implements are typically hand held and include a handle and a pointed projection which, in application, is guided through the aperture in the ring and used to secure a mechanical advantage thereagainst in the rotating motion. Examples of such implements are disclosed in U.S. Pat. No. 4,120,216 to Goldberg and U.S. Pat. No. 3,724,297 to Bucko.

The Goldberg patent discloses a can opener for use with ring-type opener tabs including a handle 20, an extension member 22 projecting away from the handle and an insertion head member 24 having rearwardly directed ears 30. The Goldberg device is operated by inserting the head portion of the opener between the top surface of the can and the ring, passing the head portion through the hole in the tab until the ears pass through the hole. By gripping the handle 20 and rotating it as illustrated in FIG. 2 of the Goldberg patent, the ring tab is severed from the can and is retained with the opener by virtue of the rearwardly directed ears.

The Bucko patent also discloses a hand held ring-type tab opener which has a handle defined by a wire frame and a pointed hook 44 which, in application, is drawn downwardly through the opening of the ring to bear upwardly thereagainst when the opener is rotated as illustrated in FIG. 1 of Bucko. Bucko also provides for retaining the severed tab with the opener once it has been removed from the can by use of a tongue 30 which traps and stores the tab for future disposal.

Although devices such as those disclosed by Goldberg and Bucko are effective and overcome some of the aforementioned shortcomings of ring-type opener tabs, their application and use is restricted solely to ring-type tabs. Because fulcrum-type opener tabs typically employ apertureless spade-type key portions, prior art openers are not acceptable. Additionally, even if prior art openers were modified to become applicable with spade-type key portions of fulcrum-type opener tabs, many shortcomings would remain. Such prior art devices are often complex and expensive to manufacture and incorporate a sharp projection which is intended to pass through the opening of the ring-type tab. This projection represents a hazard if the opener falls into the hands of a child or a careless adult. Additionally, by retaining the severed tab with the opener, prior art devices expose the user to lacerations because of the near proximity of the severed tab to the users hand after opening.

A major shortcoming of prior art devices is that they are intended to only apply pressure or mechanical advantage in one direction. That is, they only pry the tab upwardly away from the can. In the case of the fulcrum-type opener tabs, a reciprocal displacement of the key portion to its stowed or initial position is required prior to consumption of the beverage contained within the can. With prior art devices, this reciprocal or second motion had to be effected with the user's hand, thereby lessening the attractiveness of such devices.

Finally, most prior ring-tab openers were often mechanically complex and were thus not conveniently transportable. Additionally, the complexity of such openers also increased the manufacturing cost thereof thereby preventing them from being used as advertising or promotional items.

CROSS REFERENCE

The present application represents a refiling of U.S. application Ser. No. 071,275, filed Aug. 30, 1979 for Beverage Can Lift Opener, which is now abandoned.

BRIEF DESCRIPTION OF THE INVENTION

The present invention relates to a hand held opener for beverage cans or the like which employ fulcrum-type opener tabs characterized by key portions which effect opening of an aperture within an associated can through a rupturing of a wall thereof, and remain permanently affixed to the can after it is opened. According to the present invention, the hand held opener includes an elongated handle and means depending therefrom for embracing a tab and defining a key portion receiving recess operable, when held in the hand of a user, to effect opening of the can through a sequential, reciprocal displacement of the key portion from its initial or stowed position to a second, load bearing position in which it causes the rupture opening, and back to the stowed position. This arrangement provides the advantage of an extremely simple to use, inexpensive, hand held opener for fulcrum-type tabs which provides mechanical advantage upon the key portion both during opening of the can and in returning the key portion to the stowed position.

According to the preferred embodiment of the invention, the opener is formed from a single piece of metal tubing having one end crimped to define the key portion receiving recess which opens away from the remainder of the tubing or handle but at an acute angle thereto. This arrangement has the advantage of providing an extremely inexpensive and easy to manufacture opener.

According to an alternative embodiment of the invention, the opener is integrally formed from an elongated metal band whereby the tab embracing means defines bifurcated first and second tab guides which overlie and underlie the key portion respectively and define first and second tab abutting surfaces respectively. This arrangement has the advantage of providing an extremely inexpensive and easy to manufacture opener with the advantages set forth hereinabove which also can be employed with ring-type tabs if desired.

According to another aspect of the invention, advertising indicia is imprinted upon the handle. This arrangement allows the present invention to be employed for give away or promotional type activities with a maximum marketing impact at a minimum expense.

According to still another aspect of the invention, fastener means such as double sided adhesive tape, magnets or the like are provided on the handle of the opener to facilitate packaging of the device with a commercial container pack of one or more beverage cans as a retail level marketing feature.

These and other features and advantages of the present invention will become apparent upon reading the following specification, which, along with the patent drawings, describes and discloses a preferred embodiment and an alternative embodiment of the invention in detail.

The detailed description of the specific and alternative embodiments makes reference to the accompanying drawings.

DETAILED DESCRIPTION OF THE SPECIFIC EMBODIMENTS

The present invention, although relatively simple structurally, overcomes many problems of the prior art and is principally addressed to an application not contemplated by prior art devices.

Figure 1:
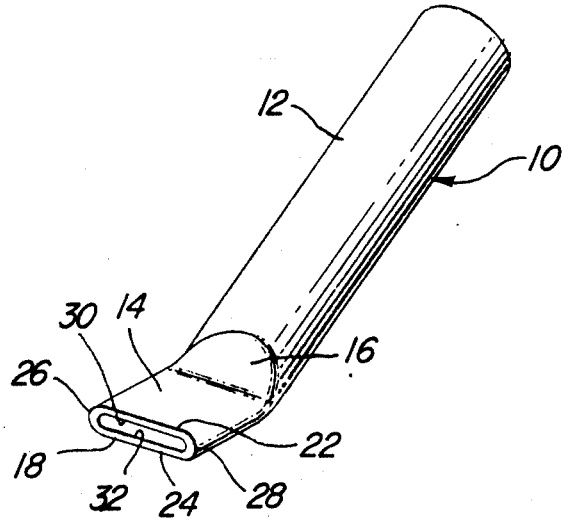
FIG. 1 is a perspective view of the preferred embodiment of the invention.

Referring to FIG. 1, a hand held opener 10 is illustrated which represents the preferred embodiment of the present invention. The opener 10 includes an elongated handle 12 which terminates at one end in a tab embracing portion 14. The opener 10 is constructed of a single length of metal tubing which can be of copper, steel, or the like. The end of the elongate handle 12 associated with the tab embracing portion 14 is flattened through a transition area 16 which transitions between a substantially circular cross-sectional area to an elongated cross-sectional area adjacent the tab embracing portion 14. The end of the tab embracing portion 14 distal the handle 12 terminates to define the opening 18 of a key portion receiving recess 20 (see FIG. 4*b*).

The wall of the tube, forming the opener 10, has been substantially flattened in the tab embracing portion 14 to define first and second tab guides 22 and 24. The lateral extremes of the tab guides 22 and 24 are integrally interconnected by first and second lateral tab guiding side walls 26 and 28 respectively. The inner surfaces of the first and second tab guides 22 and 24 define first and second tab abutting surfaces 30 and 32 respectively.

The elongated handle 12 is dimensioned so as to conveniently fit in the palm of a user's hand. The key portion receiving recess 20 is dimensioned to nestingly receive the key portion of a pop-top opening tab as will be described in detail herein below.

The key portion receiving recess 20 has an axis of symmetry running therethrough which is at all points equidistant to the first and second tab guides 22 and 24 and also equidistant to the first and second lateral tab guiding side walls 26 and 28. This axis of symmetry is offset by an angle A from the axis of elongation from the handle 12 as can best be seen in FIG. 4*b*.

Figure 2:
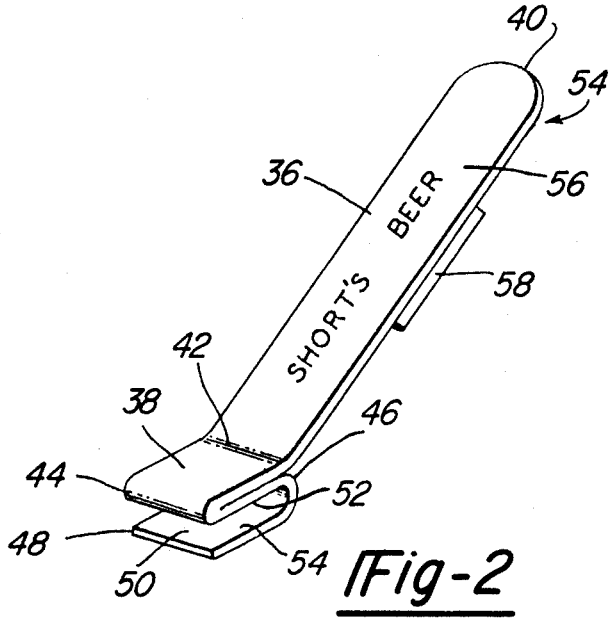
FIG. 2 is a perspective view of an alternative embodiment of the present invention.
Figure 3:
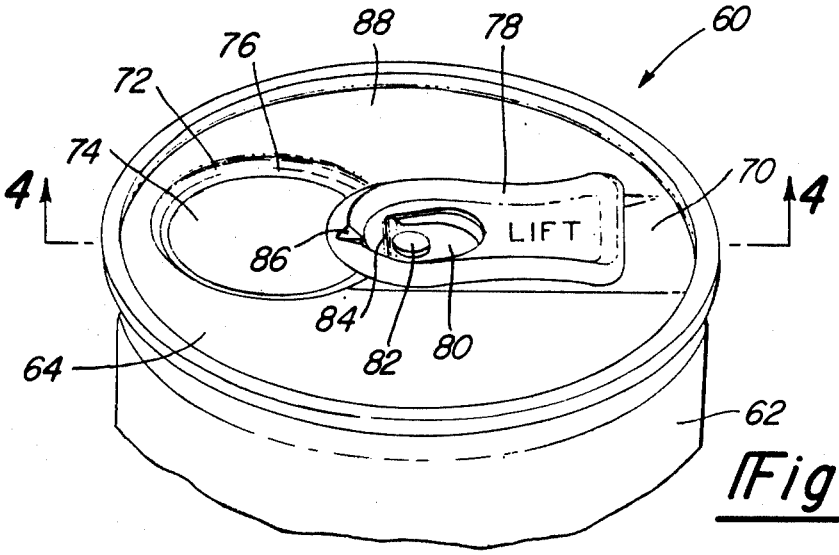
FIG. 3 is a broken perspective view of a beverage can including a fulcrum-type opener.

Referring to FIG. 2, an alternative embodiment of the present invention is illustrated. A hand held opener 34 includes an elongated handle 36 and a tab embracing portion 38. The opener 34 is constructed of a single length of metal band. The end of the elongated handle 36 not associated with the tab embracing portion 38 is rounded (generally designated 40) to comfortably fit within the palm of the user's hand. The other end of the elongated handle 36 angularly transitions at a point generally designated 42 into the tab embracing portion 38. The band illustrated is of a relatively heavy gauge and is flat. It is contemplated, however, that light gauge band can be substituted if it is curved (in cross-section) for increased structural integrity and reduced weight. From point 42, the band extends away from the elongated handle 36 for approximately one inch and then is doubled back, defining a first tab guide 44. The metal then extends back nearly to the transition point 42 and then is rounded at a point designated 46 downwardly and away from the elongated handle 36 to form a second tab guide 48. The tab guides 44 and 48 are spaced from one another to define a key portion receiving recess 50 between the first and second tab abutting surfaces 52 and 54, respectively.

Inasmuch as the present invention could well be used as a promotional give away item, it is contemplated that advertising indicia 56 may be imprinted or otherwise included on the handle 36. Additionally, fastener means such as dual sided adhesive tape 58 can be provided on the back surface of the elongated handle 36, allowing the opener 34 to be affixed to a commercial beverage container pack which could be a single can or preferably a six or eight pack beverage container joined by a cardboard or plastic carrier.

To best understand the operation of and the advantages accruing to the present invention, one must first understand in some detail the structure and operation of fulcrum-type opener tabs. Such an opener is illustrated in FIGS. 3 and 4*a–c*. A typical beverage can 60 is constructed of an extruded cup shaped body portion 62 which extends upwardly and is closed at the top by a can lid or cover 64. The uppermost edge of the body portion 62 is rolled back at a point 66 to form an area of increased wall thickness annularly about the opening of the body portion 62. The lid 64 is die formed around the circumferential edge thereof to embrace the area 66 and is sealingly affixed thereto by crimping and/or soldering once the can has been filled.

Although the present invention has been described in connection with pop and beer beverage cans it is contemplated that it could be used for other types of cans using the same fulcrum-type opener tab. A fulcrum-type opener tab generally designated at 68 is incorporated within the can lid 64.

The fulcrum-type opener tab 68 is disposed within a recess 70 in the can lid 64. The fulcrum-type tab 68 is formed within the recess 70 to provide a can 60 with a lower overall profile. However, this feature renders opening the can without the aid of the opener 10 difficult as is described hereinabove. A substantially circular scored line 72 is formed in the can lid 64 within the recess 70. The area of the can lid 64 within or defined by the scored line 72 is defined for the purposes of the present application as a closure member 74 which, prior to opening, is an integral part of the can lid 64. The score line 72 does not close upon itself, however, but leaves a small hinge portion 76 interconnecting the closure member 74 with the remainder of the can lid 64.

A key portion 78 of the fulcrum-type opener tab 68 is also disposed within the recess 70. The key portion 78 is elongated and has a lanced tab 80 formed therein which is permanently affixed to the can lid 64 through a rivet 82. The lanced tab 80 integrally joins the remainder of the key portion 78 at a living hinge 84 which is located substantially over the radially innermost extent of the score line 72. The peripheral edge of the key portion 78 is rolled over to increase cross-sectional area and, thus, structural integrity. An area of the key portion 78 to the right of the rivet 82, as viewed in FIG. 3, functions as a handle or finger grip part which is designed to be gripped between the thumb and forefinger and rotated upwardly (counterclockwise about the rivet 82). The area of the key portion 78 to the left of the rivet 82 is a load bearing portion which, in application, bears downwardly upon the closure member 74. A stress concentrating notch 86 is formed in the left-hand most peripheral edge of the key portion 78 and is the first to bear against the closure member 74 in the opening process.

The opener 10 operates to open the beverage can 60 having a fulcrum-type opener tab 68 as follows. The opener 10 is grasped in the palm of the user's hand with the tab embracing portion 14 facing outwardly. Holding the beverage can 60 in one hand, the user brings the opener 10 in contact with the can lid 64 in about the same orientation as illustrated in position II of FIG. 4*b*. The opener 10 is oriented so that the opening 18 of the key portion receiving recess 20 is just slightly right of the right-hand most portion of the key portion 78. The user then rotates the opener 10 clockwise into position I and simultaneously aligns the opening 18 with the right end of the key portion 78. In position I, the opener 10 is pushed leftwardly, thereby causing the key portion 78 to nestingly slide within the tab embracing portion 14 until the left-hand most extent of the second tab guide 24 abuts the left-hand most extent of the lanced tab 80. At this point, the opener 10 is in its proper orientation for opening the can 60. This is effected through a sequential reciprocal displacement of the opener 10 and the key portion 78 from position I to position III and back to position I as illustrated in FIG. 4*b*. Position III and intermediate positions between position I and position III are designated load bearing positions, i.e., whenever the stress concentrating notch 86 is abutting the closure member 74. The first position I is designated the stowed or initial position. As the opener 10 is displaced counterclockwise from position I, the stress concentrating notch 86 comes in contact with the closure member 74. The key portion 78 remains attached to the can lid 64 through the rivet 82 but is being angularly displaced with respect thereto through the living hinge 84. As the opener 10 is angularly displaced counterclockwise further and further, the stress concentrating notch 86 bears down further against the closure member 74 and effects a rupture opening of a contents dispensing aperture (defined by the score line 72).

Figure 4A:
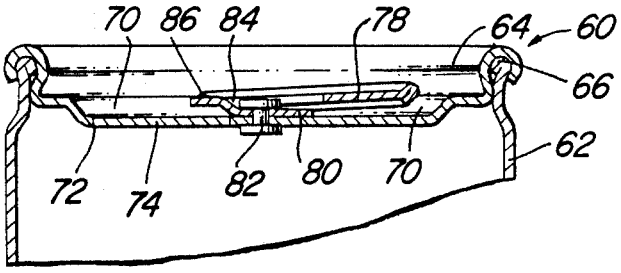
FIG. 4*a* is a cross-sectional view of the beverage can of FIG. 3, with the key portion of the fulcrum-type opener in its stowed position.
Figure 4B:
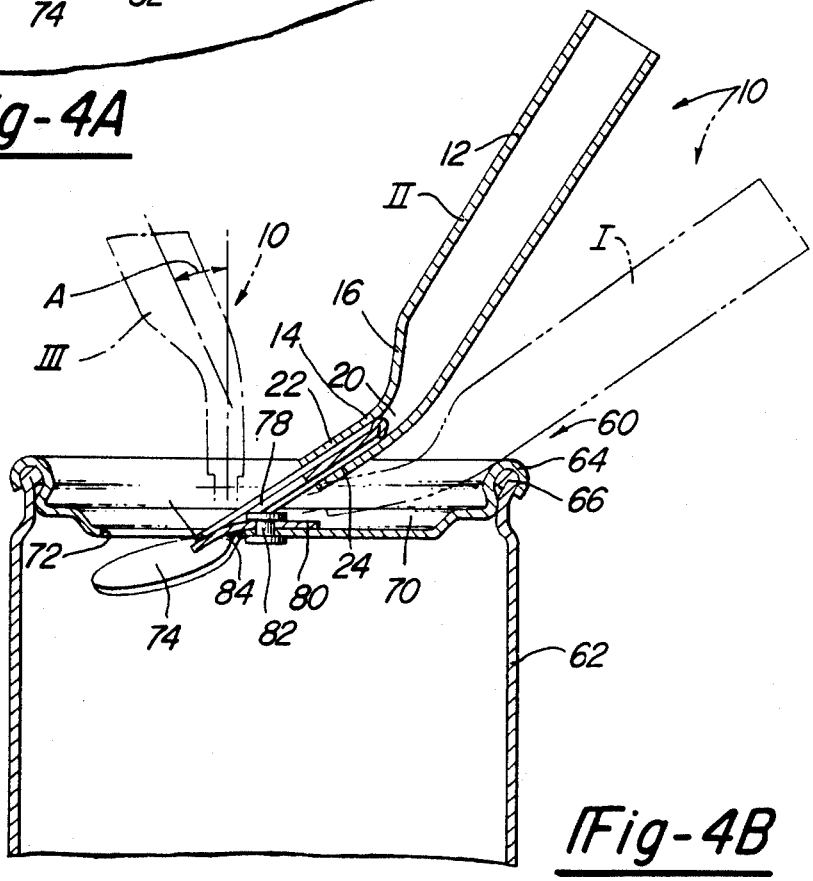
FIG. 4*b* is a cross-sectional view of the beverage can of FIG. 3, with the key portion of the fulcrum-type opener in an intermediate position and inserted within the key portion receiving recess of the present invention.
Figure 4C:
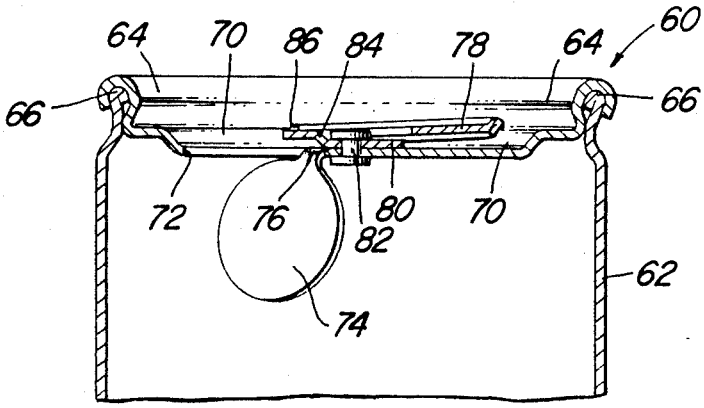
FIG. 4*c* is a cross-sectional view of the beverage can of FIG. 3, with the key portion of the fulcrum-type opener returned to its stowed position after opening the can's contents dispensing aperture.

FIG. 4*a* illustrates the beverage can 60 in its closed, sealed condition. FIG. 4*b* illustrates the can 60 with the closure member 74 in an intermediate position and FIG. 4*c* shows the beverage can 60 with the closure member 74 in a fully opened condition and the key portion 78 returned to the stowed position. As can now be appreciated, the angular offset A, as designated in position III in FIG. 4*b*, is provided to facilitate initial insertion of the key portion 78 within the key portion receiving recess 20. The can lid 64 will rupture along the score line 72 clockwise as viewed in FIG. 3 starting at the portion of the can lid 64 directly beneath the stress concentrating notch 86 and ending clockwise therefrom adjacent the hinge portion 76.

Once the opener 10 has been rotated counterclockwise to position II, the closure member 74 will be substantially severed from the remainder of the can lid 64 as illustrated in FIG. 4*c*. The opener 10 is then rotated clockwise from position III back to position I and the opener 10 is removed from the can and the contents consumed.

Although the written description of the foregoing process appears somewhat laborious, the inventors have found that in practice, the present inventive opener is extremely convenient and simple to use and, with practice, can effect opening of pop-top cans more rapidly than can be achieved with bare hands.

Although the preferred and alternative embodiments have been described as being constructed from metal, it is contemplated that they could also be formed from injection molded plastic or other process. There are no specific dimensional limitations contemplated with the exception that the first and second tab guides 22 and 24 (44 and 48) must be spaced from one another just slightly more than the thickness of the key portion 78. Additionally, the first and second lateral tab guiding side walls 26 and 28 must also be laterally spaced from one another slightly more than the lateral width of the key portion 78. The lateral tab guiding sidewalls 26 and 28 are optional of course and have been deleted in the alternative embodiment of FIG. 2. Although the present invention is primarily intended for use with fulcrum-type opener tabs having spade type key portions, it is contemplated that it could also be used with pop-top tab openers with ring-type key portions.

It is to be understood that the invention has been described with reference to specific embodiments which provide the features and advantages previously described, and that such specific embodiments are susceptible to modification as will be apparent to those skilled in the art. Accordingly, the foregoing description is not to be construed in a limiting sense.

What is claimed is:

1. A hand held opener to provide leverage in the opening of a beverage containing can employing a fulcrum-type opener characterized by a peripherally weakened closure member integrally formed in the top of said can and a key portion which effects ruputure opening of a contents dispensing aperture within said top about the periphery of said closure member and remains permanently affixed thereto after said opening, said key portion initially being disposed substantially parallel to and spaced slightly above a substantially horizontal planar portion of said top, said can being characterized by an upwardly depending edge portion circumferentially encompassing said fulcrum-type opener and extending substantially above said key portion, said hand held opener comprising:

an elongated handle adapted to be grasped in the hand of an operator so that one end of said handle projects outwardly therefrom in the general direction of a beverage containing can to be opened; and tab embracing means depending from said handle and defining a key portion receiving recess therein having an axis of symmetry offset by a substantial angle from the axis of elongation of said handle, said tab embracing means comprising bifurcated upper and lower tab guides spaced from one another to receive said key portion therebetween with said upper tab guide being at least axially coextensive with said lower tab guide, said tab embracing means being operable, in combination with said handle, to effect mechanical linkage between said hand held opener and said key portion while avoiding interference with said upwardly depending edge portion, and subsequently to effect opening through a sequential reciprocal displacement of said key portion from a first, stowed position to a second, load bearing position and back to said first position.

2. The opener of claim 1 wherein said upper and lower tab guides define first and second tab abutting surfaces respectively, said surfaces being substantially parallel and spaced from one another to define said key portion receiving recess.

3. The opener of claim 2, wherein said tab embracing means further comprises first and second lateral tab guiding sidewalls.

4. The opener of claim 1, wherein said handle is formed from an elongated metal band.

5. The opener of claim 4 wherein said tab embracing means is integrally formed from said metal band and wherein said key portion receiving recess is outwardly opening, said tab embracing means depending from one end of said handle in a serpentine segment defining said bifurcated upper and lower tab guides.

6. The opener of claim 4 wherein said metal band comprises a light gauge metal and said elongated handle comprises a curved cross section for increased structural integrity.

7. The opener of claim 4 wherein said serpentine segment defining said bifurcated upper and lower tab guides comprises a first serpentine portion extending forwardly away from said elongated handle, a second serpentine portion doubling back from said first serpentine portion towards said elongated handle, a third serpentine portion projecting downwardly from said second serpentine portion to define the width of said key portion receiving recess, and a fourth serpentine portion extending forwardly from said third serpentine portion away from said elongated handle.

8. The opener of claim 1 wherein said handle is formed from a metal tube and wherein said tab embracing means is integrally formed from said metal tube, said tube being crimped at one end to define an outwardly opening key portion receiving recess having an axis of symmetry offset by a substantial angle from the axis of elongation of said handle.

9. The opener of claim 8 wherein said tab embracing means further comprises first and second tab guide sidewalls laterally spaced to closely receive said key portion therebetween, integrally formed with said upper and lower tab guides and substantially axially coextensive therewith to prevent relative lateral displacement between said key portion and hand held opener during said mechanical linkage.

* * * * *